US009689304B2

(12) United States Patent
Benet

(10) Patent No.: US 9,689,304 B2
(45) Date of Patent: Jun. 27, 2017

(54) COOLING CIRCUIT FOR THE THERMAL REGULATION OF AN ENGINE INDEPENDENT FROM OTHER CONSUMERS

(75) Inventor: Frederic Benet, Buc (FR)

(73) Assignee: RENAULT S.A.S., Boulogne-Billancourt (FR)

( * ) Notice: Subject to any disclaimer, the term of this patent is extended or adjusted under 35 U.S.C. 154(b) by 463 days.

(21) Appl. No.: 13/121,832

(22) PCT Filed: Sep. 30, 2009

(86) PCT No.: PCT/FR2009/051857
§ 371 (c)(1),
(2), (4) Date: Jun. 17, 2011

(87) PCT Pub. No.: WO2010/037970
PCT Pub. Date: Apr. 8, 2010

(65) Prior Publication Data

US 2011/0232590 A1 Sep. 29, 2011

(30) Foreign Application Priority Data

Sep. 30, 2008 (FR) ..... 08 05384

(51) Int. Cl.
*F01P 7/14* (2006.01)
*F01P 7/16* (2006.01)
(Continued)

(52) U.S. Cl.
CPC ..... *F01P 7/165* (2013.01); *F01P 3/02* (2013.01); *F01P 3/20* (2013.01); *F01P 2060/02* (2013.01); *F01P 2060/08* (2013.01)

(58) Field of Classification Search
CPC ..... F01P 7/14; F01P 7/16; F01P 7/165; F01P 2007/146
(Continued)

(56) References Cited

U.S. PATENT DOCUMENTS 4,180,032 A * 12/1979 Plegat ..... F01P 3/20 123/563
4,926,801 A * 5/1990 Eisenberg ..... F02F 1/163 123/193.2
(Continued)

FOREIGN PATENT DOCUMENTS

FR 2 883 807 10/2006
FR 2 908 458 5/2008
FR 2908458 A1 * 5/2008 ..... F01P 3/20

OTHER PUBLICATIONS

International Search Report issued May 7, 2010 in PCT/FR09/51857 filed Sep. 30, 2009.

*Primary Examiner* — Stephen K Cronin
*Assistant Examiner* — Omar Morales
(74) *Attorney, Agent, or Firm* — Oblon, McClelland, Maier & Neustadt, L.L.P.

(57) ABSTRACT

A thermal regulation device for a cooling system of an engine that includes a pump positioned upstream from a cooling housing of the engine and at least one consumer requiring permanent cooling. The device includes a main pipe for circulating coolant through the cooling housing and a secondary pipe bypassing the cooling housing. A two-way valve is positioned on the main pipe at the outlet of the cooling housing of the engine, and the secondary pipe includes a tapping on the main pipe downstream from the pump and upstream from a portion of the main pipe used for cooling the engine so that the flow is maintained at a constant and permanent level for ensuring the cooling of the at least one consumer.

15 Claims, 3 Drawing Sheets

(51) Int. Cl.
*F01P 3/02* (2006.01)
*F01P 3/20* (2006.01)

(58) Field of Classification Search
USPC ..... 123/41.09, 41.1, 568.12, 41.08, 41.52, 123/41.44, 41.29
See application file for complete search history.

(56) References Cited

U.S. PATENT DOCUMENTS

| | | | | |
|---|---|---|---|---|
| 5,871,041 | A * | 2/1999 | Rafalovich et al. | 165/10 |
| 5,941,220 | A | 8/1999 | Kuhn | |
| 6,082,626 | A * | 7/2000 | Morikawa et al. | 237/12.3 B |
| 6,810,838 | B1 | 11/2004 | Hellman | |
| 6,899,162 | B2 * | 5/2005 | Hohl et al. | 165/41 |
| 7,210,522 | B2 * | 5/2007 | Gruian | F01P 3/20 123/41.1 |
| 2003/0114978 | A1 * | 6/2003 | Rimnac | F02B 29/0418 701/108 |

* cited by examiner

COOLING CIRCUIT FOR THE THERMAL REGULATION OF AN ENGINE INDEPENDENT FROM OTHER CONSUMERS

BACKGROUND

The present invention relates to the field of systems for the thermal regulation of engines and, more specifically, to the field of systems for regulating the distribution of the liquid coolant in an engine.

By regulating the temperature of the combustion engine it becomes possible to conceive of reducing the emissions of pollutants of the fuel consumption of the engine as the engine warms up. During the transient phase, as the combustion engine warms up, it is found to consume excessive amounts of fuel as a result of the high viscosity of the engine lubricating oil and as a result of a phenomenon of incomplete combustion with significant emissions of hydrocarbons and monoxides, notably of carbon and of nitrogen, because of the low combustion chamber wall temperature.

In order to reduce the consumption and pollutant emissions as the combustion engine warms up, the engine is not cooled. The metallic masses and the lubricating oil have temperatures which increase more rapidly than they would if liquid coolant was circulated through the engine. The flow rate of liquid coolant through the engine is therefore shut off during the warming-up phase.

At the same time, in order to restrict the amount of emissions of monoxides, for example of nitrogen, the exhaust gases are fed back from the exhaust to the intake side of the combustion engine, causing them to undergo a cooling step, using an E.G.R (exhaust gas recirculation) system. Likewise, in order to cool the turbocompressor bearing, it is appropriate to use a cooled casing in which the liquid coolant circulates so as to pick up heat from the metallic mass and from the oil of the turbocompressor.

These various thermal regulations of the engine, on the one hand, and of the consumers that are the turbocompressor and the E.G.R device that recirculates the gases, on the other hand, need to be performed at the same time. Specifically, during the warm-up phase, it is important for the turbocompressor and the exhaust gas recirculation device always to be cooled.

At the present time, thermal regulation involves a wax thermostat incorporated into the combustion engine cooling circuit. It is important that the new regulations be carried out with a limited additional cost over the existing regulating systems.

Various devices have been proposed in an attempt to address the problems of the various forms of thermal regulation with the circulation of liquid coolant when carrying out thermal regulation on an engine.

One known system for regulating the circulation of liquid coolant involves positioning a three-way valve on the inlet side of the engine, downstream of the water pump, this three-way valve supplying a pipe that allows the liquid coolant to circulate between the water pump downstream of the engine and an engine outlet which supplies the consumers. However, such a system has the disadvantage of being unable to conform to the fitting requirements especially since fitting a valve between the water pump and the crankcase upper half of the engine remains a complicated task.

An alternative form of this system for regulating the circulation of liquid coolant is to position the three-way valve on the outlet side of the engine, this valve supplying the pipe with short-circuits the circulation of liquid coolant through the engine. However, this solution does not address the problem of fitting a tapping between the water pump and the crankcase upper half of the engine.

BRIEF SUMMARY

It is an object of the present invention to propose a solution which gets around at least one of the disadvantages of the prior art and notably to propose a thermal regulation system which manages the circulation of liquid coolant through a combustion engine and its consumers without the need for a tapping to be fitted at the interface between the water pump and the crankcase upper half of the engine.

This objective is achieved by virtue of a thermal regulation device for a cooling system for cooling at least one internal combustion engine, comprising a pump positioned upstream of a cooling chamber of the crankcase/cylinder block and/or the cylinder head of the engine and at least one consumer requiring permanent cooling, the device comprising at least one main pipe allowing the liquid coolant to circulate through the cooling chamber of the engine and a secondary pipe which bypasses the cooling chamber of the engine, characterized in that a two-way valve is positioned on the main pipe, at the outlet from the cooling chamber of the engine, and in that the secondary pipe comprises a tapping off the main pipe, downstream of the pump and upstream of that portion of the main pipe which contributes to the cooling of the engine, so that the flow rate is kept constant and permanent to supply the cooling of at least one consumer.

According to an alternative form of embodiment, the cooling device for a system for cooling at least one internal combustion engine according to the invention is characterized in that, with the main pipe at its end connected to the pump comprising a distribution gallery which runs alongside the crankcase/cylinder block and/or the cylinder head and which distributes the liquid coolant into several accessory pipes which lead from the distribution gallery and which are intended for cooling the engine, the gallery not contributing to an exchange of heat with the engine, the tapping of the secondary pipe off the main pipe is on the distribution gallery.

According to another alternative form of embodiment, the cooling device for a system of cooling at least one internal combustion engine according to the invention is characterized in that the tapping of the secondary pipe off the distribution gallery is positioned in such a way as to provide an even distribution of flow rates of liquid coolant between the secondary pipe and the various accessory pipes.

Another objective of the invention is to propose a system able to incorporate the device of the invention.

This object is achieved by virtue of a cooling circuit for the thermal regulation of an engine and of at least one consumer, comprising a feed pump for displacing a liquid coolant, characterized in that the cooling circuit comprises a thermal regulation device according to the invention, the regulation device on the one hand via its main pipe at the outlet of the engine supplying a first loop which comprises at least one accessory that has to be cooled, and on the other hand via its secondary pipe supplying a second loop which comprises at least one consumer that requires permanent and/or continuous cooling while the engine is running, the second loop opening at its downstream end into the first loop of the cooling circuit.

According to an alternative form of embodiment, the cooling circuit for the thermal regulation of an engine and of at least one consumer through the displacement of a liquid coolant according to the invention is characterized in that at the outlet from the engine, the main pipe supplies a third loop which cools at least one accessory, this third loop meeting the first loop upstream of the pump, and this third loop comprising a two-way thermostatic valve.

According to another alternative form of embodiment, the cooling circuit for the thermal regulation of an engine and of at least one consumer through the displacement of a liquid coolant according to the invention is characterized in that the third loop meets the first loop via a double-acting thermostatic valve supplied by a pipe which makes a tapping downstream of the two-way valve of the first loop, the double-acting thermostatic valve making it possible to regulate the temperature of the liquid coolant while at the same time maintaining a flow of liquid coolant with a constant flow rate through the engine.

According to another alternative form of embodiment, the cooling circuit for the thermal regulation of an engine and of at least one consumer through the displacement of a liquid coolant according to the invention is characterized in that the consumer requiring permanent and/or continuous cooling is formed of at least one turbocompressor and/or an exhaust gas recirculation device and/or in that the first loop contributes to supplying at least one unit heater and/or in that the third loop contributes to supplying at least one radiator.

Another objective of the invention is to propose at least one method for operating the cooling circuit of the invention.

This object is achieved by virtue of a method of operating a cooling circuit according to the invention, characterized in that the method comprises at least one step of closing the two-way valve mounted on the first loop of the cooling circuit in order, on the one hand, to suspend the cooling of the engine and, on the other hand, to maintain constant cooling of at least one consumer.

According to an alternative form of embodiment, the method of operating a cooling circuit according to the invention is characterized in that the method comprises at least one step of opening the two-way valve mounted on the first loop of the cooling circuit in order, on the one hand, to allow the cooling of the engine and, on the other hand, to maintain constant cooling of at least one consumer.

According to another alternative form of embodiment, the method of operating a cooling circuit according to the invention is characterized in that the method comprises at least one step of opening the thermostatic two-way valve mounted on the third loop of the cooling circuit in order, on the one hand, to allow the cooling of the engine and, on the other hand, to allow the cooling of at least one accessory of the third loop, while at the same time maintaining constant cooling of at least one consumer using the second loop of the cooling circuit.

BRIEF DESCRIPTION OF THE DRAWINGS

The invention, together with its features and advantages, will become more clearly apparent from reading the description which is given with reference to the accompanying drawings in which.

DETAILED DESCRIPTION

Figure 1:
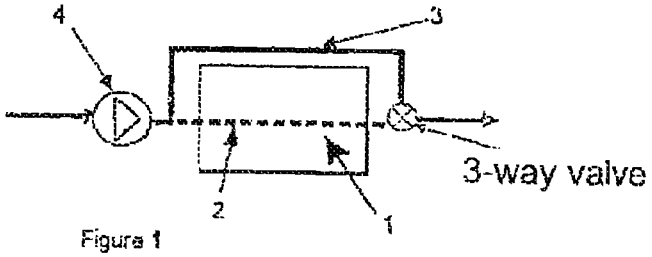
FIG. 1 is a layout diagram for a device for thermal regulation in the region of an engine according to the prior art.
Figure 2:
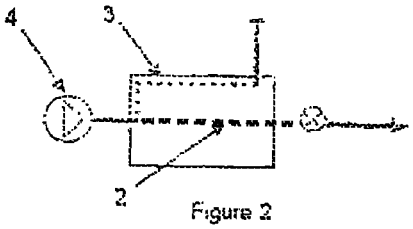
FIG. 2 is a layout diagram for a device for thermal regulation in the region of an engine according to the invention.
Figure 3:
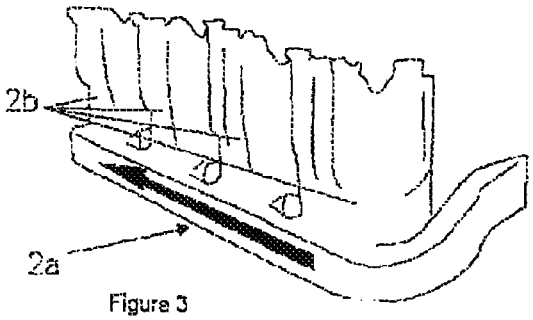
FIG. 3 is one embodiment of a device for thermal regulation in the region of an engine that can be adapted to correspond to the device of the invention.
Figure 4:
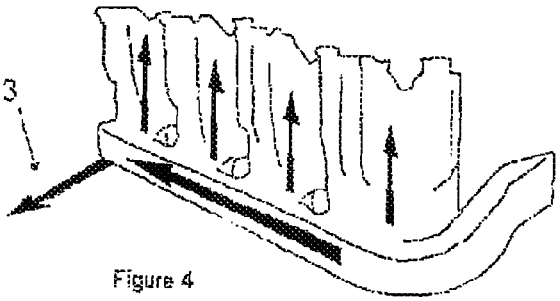
FIG. 4 is one embodiment of a device for thermal regulation in the region of an engine according to the invention, FIG. 5 schematically depicts one example of a cooling circuit incorporating the device of the invention and operating with all the valves closed, FIG. 6 schematically depicts one example of a cooling circuit incorporating the device of the invention and operating with just the valve on the main pipe open, FIG. 7 schematically depicts one example of a cooling circuit incorporating the device of the invention and operating with all the valves of the circuit open, FIG. 8 schematically depicts an alternative form of embodiment of the diagram of FIG. 7, FIG. 9 schematically depicts an alternative form of embodiment of the diagram of FIG. 7 including a double-acting thermostatic valve.
Figure 5:
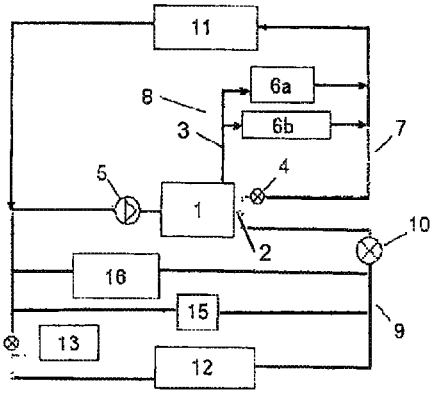
Figure 6:
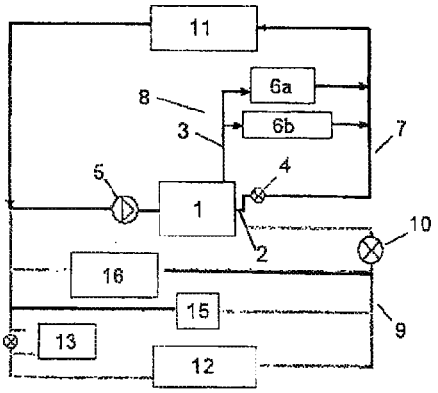
Figure 7:
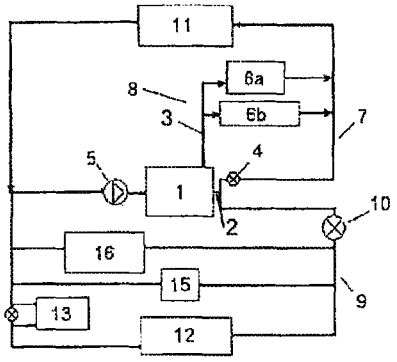
Figure 8:
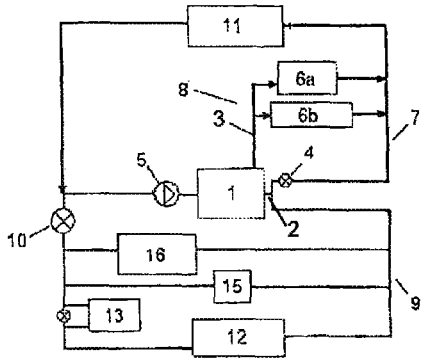
Figure 9:
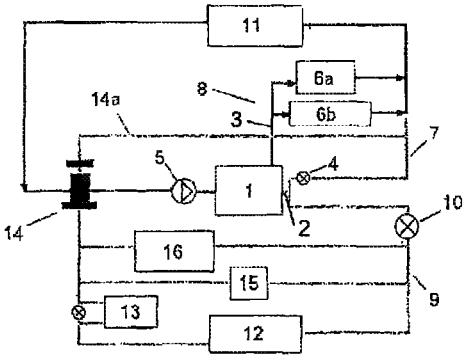

It should be pointed out that, in the present document, the terms "upstream" and "downstream" used to site various elements relative to one another are used with reference to the direction in which the liquid coolant flows through the circuit or circuits to which they relate.

The thermal regulation device of the cooling system of the invention is intended to be positioned in the periphery of an engine (1) and notably in the region of the chamber involved in the cooling of the crankcase/cylinder block and/or the cylinder head of the engine. This device comprises a main pipe (2) which circulates the liquid coolant through the chamber of the crankcase/cylinder block and/or the cylinder head (1). Associated with this main pipe (2) is a secondary pipe (3) which collects part of the flow rate from the main pipe (2) and deviates it away from the cooling chamber of the engine (1). The tapping of the secondary pipe (3) off the main pipe (2) is upstream of the engine inlet for liquid coolant and downstream of a feed pump (5) so that the two pipes (2, 3) are supplied from the same pump (5), while at the same time allowing the secondary pipe (3) to be supplied with liquid coolant which has not yet exchanged heat with an element that requires cooling. On the outlet side of the engine, the main pipe (2) comprises a two-way valve (4) which allows the flow rate of liquid coolant through the main pipe (2) to be suspended reversibly. The siting of this valve (4) makes it possible to avoid having to site a component at the interface between the pump (5) and the engine (1) that is to be cooled. In addition, thanks to the tapping of the secondary pipe (3) off the main pipe (2) upstream of the engine inlet, the closing of the valve (4) allows the flow rate of liquid coolant through the main pipe (2) to be stopped while at the same time maintaining a continuous flow through the secondary pipe (3).

At the cooling chamber, the main pipe (2) may, at its end positioned directly downstream of the pump (5), comprise a distribution gallery (2*a*) which runs alongside at least part of the crankcase/cylinder block and/or the cylinder head of the engine. Emanating from this distribution gallery (2*a*) are several accessory pipes (2*b*) which contribute directly to the cooling of the engine (1) by supplying various zones of the cooling chamber. The distribution gallery (2*a*) itself plays no direct part in the cooling of the engine (1) which means that the liquid coolant passing through it comes directly from the pump (5) and has not yet exchanged heat with the engine (1). The heat exchange capacity of the liquid coolant collected by the secondary pipe (3) is therefore optimal. The tapping of the secondary pipe (3) can then be directly off the length of the distribution gallery (2*a*). According to a preferred embodiment, the tapping of the secondary pipe (3) off the distribution gallery (2*a*) is such that the distribution between the secondary pipe (3) and the various accessory pipes (2*b*) is balanced.

The thermal regulation device of the invention is intended to be incorporated into a cooling circuit of an engine (1), but also of one or more consumers (6) and/or accessories (11, 12, 13, 15, 16). These consumers (6) are generally the turbocompressor (6*a*) and the exhaust gas recirculation device (6*b*) which require permanent cooling by the cooling circuit, independently of the thermal regulation performed in the region of the crankcase/cylinder block and cylinder head of the engine (1).

The cooling circuit incorporating the device of the invention has a first cooling loop (7) which notably comprises the pump (5) and the main pipe (2) that contributes to the cooling of the engine (1) and at least one accessory, for example a unit heater (11), cooled by the circuit of the first cooling loop (7). The only constraint on the siting of the unit heater is that it needs to be positioned on the main loop (7). This is because the latter does have to be supplied with liquid coolant that has passed through the engine when the thermostat (4) is open. The circulation of the flow of liquid coolant through the first cooling loop (7) is dependent on the opening and on the closing of the two-way valve (4) which allows the cooling of the engine (1) to be stopped, leaving the liquid coolant to stagnate in the chamber of the crankcase/cylinder block and/or cylinder head.

Added to the first cooling loop (7) of the circuit is a second loop (8) which short-circuits the first loop (7) by bypassing the cooling of the engine via the secondary pipe (3) of the device of the invention. This second loop (8) also comprises the pump (5) and possibly one or more accessories that require cooling, such as the unit heater (11) for example. By contrast, this second loop (8) has, in the region of the secondary pipe (3) that short-circuits the main pipe (2) and therefore the cooling of the engine (1), one or more of the consumers (6) that require sustained cooling. These consumers (6) may be positioned in series or in parallel depending on the desired mode of cooling. Downstream of these consumers (6), the secondary pipe (3) meets the circuit of the first loop (7) upstream or downstream of one or more of the accessories (11) cooled by the first loop (7). However, the meeting point between the secondary pipe (3) and the circuit of the first loop (7) is downstream of the two-way valve (4) that regulates the flow rate of liquid coolant through the chamber of the engine (1). Thus, unlike the first loop (7) of the cooling circuit, this second loop (8) has no valve in its path to stop the flow of liquid coolant. The cooling of the consumers (6) by this second loop (8) is therefore permanent and independent of whether the valve (4) of the main pipe (2) is open or closed and therefore independent of the cooling of the crankcase upper half and/or of the cylinder head of the engine (1).

To these first two loops (7, 8) a third loop (9) may be added to the cooling circuit. This loop (9), like the first loop (7), comprises the feed pump (5) and the main pipe (2) which contributes to the cooling of the engine (1). By contrast, downstream or upstream of the two-way valve (4) of the first loop (7), depending on the embodiment, the circuit of the third loop (9) separates to contribute to the cooling of one or more accessories, such as a radiator (12), a gearbox (13), a jar (15) or a water/oil exchanger (16), which are positioned in series or in parallel on the cooling loop (9). The third cooling loop (9) meets the first loop (7) upstream of the feed pump (5). Depending on whether the tapping for the third loop (9) is upstream or downstream of the valve (4) of the first loop (7), the flow of liquid coolant through this third loop (9) may be controlled by the valve (4) of the first loop (7). However, according to a preferred embodiment, the tapping is on the outlet side of the engine (1) upstream of the valve (4) of the first loop (7), whereas a thermostatic two-way valve (10) is fitted to the circuit of the third cooling loop (9). According to the embodiment, this valve (10) is positioned on the loop (9) on the engine outlet side downstream of the tapping of the third loop (9) off the first loop (7), so that it is sited upstream of the accessories (12, 13, 15, 16) the supply of coolant to which it controls. In an alternative form of embodiment of the cooling circuit, this valve (10) is positioned on the loop (9) downstream of the accessories (12, 13, 15, 16) of the loop (9) and upstream of where the third loop (9) meets the first loop, this meeting point being upstream of the feed pump (5).

The thermostatic two-way valve (10) makes it possible to manage the circulation through the third loop (9) of the circuit according to the temperature of the liquid coolant circulating. According to one particular embodiment, the thermostatic valve may, for example, incorporate a mixture of wax which becomes progressively more liquid as the temperature of the coolant, in which the thermostatic valve is immersed, increases. As it liquefies, the wax mixture progressively expands to occupy a greater volume, thus causing a shutter or piston of the valve to move.

According to an alternative form of embodiment, the meeting point between the third loop (9) and the first loop (7), which is on the return side of the loops, upstream of the feed pump (5), is the point at which a double-acting thermostatic valve (14) is sited. This double-acting valve (14) allows the temperature of the liquid coolant to be regulated, just as would a single-acting thermostatic valve, but keeping a flow of liquid coolant at a flow rate that remains constant irrespective of whether the thermostatic valve (14) is in an open, closed or regulating position. In order to allow a constant flow rate to be sustained, the thermostatic valve (14) is supplied by a pipe (14*a*) which taps off the first loop downstream of the two-way valve (4) of the main pipe (2).

When the regulating device of the invention is used in a cooling circuit, the loops followed through the circuit will depend on the openness of the various valves (4, 10, 14). When all the valves are closed, the liquid coolant has a flow rate which is kept constant in the second loop (8) of the circuit, that is to say notably in the secondary pipe (3), to allow certain consumers (6), such as the turbocompressor (6*a*) and/or the exhaust gas recirculation device (6*b*), to be cooled, while at the same time preventing the cooling of the engine (1) with a zero flow rate through the main pipe (2) of the device. The circulation of liquid coolant is kept constant by the feed pump (5) and the short-circuiting of the cooling of the engine (1) by the secondary pipe (3).

When the two-way valve (4) is open, liquid coolant circulates through the first loop (7) and the second loop (8). The main pipe (2) of the device is then supplied with fluid and the engine (1) is cooled by the moving liquid coolant.

When the thermal two-way valve (10) of the third loop (9) of the circuit is open, liquid coolant is then also allowed to circulate through the main pipe (2) to allow the cooling of the engine (1) concomitant with the displacement of fluid through the entirety of the third loop (9) to allow one or more accessories (12, 13, 15, 16) to be cooled.

It should be obvious to those skilled in the art that the present invention allows embodiments in numerous other specific forms without departing from the field of application of the invention as claimed. Therefore, the present embodiments are to be considered as illustrative but may be modified within the field defined by the scope of the attached claims.

The invention claimed is:

1. A thermal regulation device for a cooling system for cooling at least one internal combustion engine, including a pump positioned upstream of a cooling chamber of a crankcase/cylinder block and/or a cylinder head of the engine and at least one consumer requiring permanent cooling, the device comprising:

a main pipe including a first portion extending from an outlet of the pump into an inlet of the cooling chamber of the engine to circulate liquid coolant through the cooling chamber of the engine and a second portion extending from an outlet of the cooling chamber to an inlet of the pump, the main pipe including at least one accessory that is positioned on the second portion of the main pipe and cooled by the liquid coolant circulating through the main pipe;

a secondary pipe that bypasses the cooling chamber of the engine; and a two-way valve positioned on the second portion of the main pipe, at the outlet from the cooling chamber of the engine, wherein, an end of the first portion of the main pipe is connected to the outlet of the pump and comprises a distribution gallery that runs alongside the crankcase/cylinder block and/or the cylinder head and that distributes the liquid coolant into plural accessory pipes that lead from the distribution gallery and that are intended for cooling the engine, the gallery not contributing to an exchange of heat with the engine, and wherein the secondary pipe is branched off from the main pipe on the distribution gallery downstream from the plural accessory pipes, downstream of the pump, and upstream of the two-way valve, and the secondary pipe re-connects to the second portion of the main pipe immediately downstream of the two-way valve and upstream of the at least one accessory of the second portion of the main pipe so that, when the two-way valve is closed, a flow rate of the liquid coolant through the secondary pipe is kept constant and permanent to supply the cooling of the at least one consumer and the at least one accessory, and the liquid coolant does not flow through the cooling chamber of the engine.

2. The thermal regulation device for a system for cooling at least one internal combustion engine as claimed in claim 1, wherein the branch of the secondary pipe off the distribution gallery is positioned to provide an even distribution of flow rates of liquid coolant between the secondary pipe and accessory pipes.

3. A cooling circuit for thermal regulation of an engine and of at least one consumer, including a feed pump for displacing a liquid coolant, wherein the cooling circuit comprises:

a thermal regulation device as claimed in claim 1, the regulation device via the main pipe at the outlet of the engine supplying a first loop that comprises the at least one accessory, and via the secondary pipe supplying a second loop that comprises the at least one consumer that requires permanent and/or continuous cooling while the engine is running, the second loop opening at a downstream end into the first loop of the cooling circuit.

4. The cooling circuit for thermal regulation of an engine and of at least one consumer through the displacement of a liquid coolant as claimed in claim 3, wherein at an outlet from the engine, the main pipe supplies a third loop that cools at least one accessory, a third loop meeting the first loop upstream of the pump, and the third loop comprising a two-way thermostatic valve.

5. The cooling circuit for the thermal regulation of an engine and of at least one consumer through the displacement of a liquid coolant as claimed in claim 4, wherein the third loop meets the first loop via a double-acting thermostatic valve supplied by a pipe that makes a tapping downstream of the two-way valve of the first loop, the double-acting thermostatic valve making it possible to regulate temperature of the liquid coolant while at a same time maintaining a flow of liquid coolant with a constant flow rate through the engine.

6. A method of operating a cooling circuit as claimed in claim 4, wherein the method comprises opening the thermostatic two-way valve mounted on the third loop of the cooling circuit to allow the cooling of the engine and to allow the cooling of the at least one accessory of the third loop, while at a same time maintaining constant cooling of the at least one consumer using the second loop of the cooling circuit.

7. The cooling circuit for the thermal regulation of an engine and of at least one consumer through the displacement of a liquid coolant as claimed in claim 3, wherein the consumer requiring permanent and/or continuous cooling comprises at least one turbocompressor and/or an exhaust gas recirculation device.

8. A method of operating a cooling circuit as claimed in claim 3, wherein the method comprises closing the two-way valve mounted on the first loop of the cooling circuit to suspend the cooling of the engine and to maintain constant cooling of the at least one consumer.

9. A method of operating a cooling circuit as claimed in claim 3, wherein the method comprises opening the two-way valve mounted on the first loop of the cooling circuit to allow the cooling of the engine and to maintain constant cooling of the at least one consumer.

10. The cooling circuit for the thermal regulation of an engine and of at least one consumer through the displacement of a liquid coolant as claimed in claim 3, wherein the first loop contributes to supplying at least one unit heater.

11. The cooling circuit for the thermal regulation of an engine and of at least one consumer through the displacement of a liquid coolant as claimed in claim 4, wherein the third loop contributes to supplying at least one radiator.

12. The cooling circuit for the thermal regulation of an engine and of at least one consumer through the displacement of a liquid coolant as claimed in claim 3, wherein at least one turbocompressor is connected to the secondary pipe downstream of the branch off the main pipe such that the flow rate of the coolant to the turbo compressor is kept constant and permanent even when the two-way valve at the outlet from the cooling chamber of the engine is closed to stop the coolant from flowing through the cooling chamber of the engine.

13. The cooling circuit for the thermal regulation of an engine and of at least one consumer through the displacement of a liquid coolant as claimed in claim 3, wherein an exhaust gas recirculation device is connected to the secondary pipe downstream of the branch off the main pipe such that the flow rate of the coolant to the exhaust gas recirculation device is kept constant and permanent even when the two-way valve at the outlet from the cooling chamber of the engine is closed to stop the coolant from flowing through the cooling chamber of the engine.

14. The thermal regulation device for a system for cooling at least one internal combustion engine as claimed in claim 1, wherein the first portion of the main pipe does not include a valve between the pump and the cooling chamber of the engine and the secondary pipe does not include a valve.

15. The thermal regulation device for a system for cooling at least one internal combustion engine as claimed in claim 1, wherein the secondary pipe re-connects to the second portion of the main pipe immediately downstream of the two-way valve such that no consumer to be cooled by the coolant flow through the main pipe is positioned on the second portion of the main pipe between the two-way valve and where the secondary pipe re-connects to the second portion of the main pipe.

* * * * *